US009516723B2

(12) United States Patent
Mao et al.

(10) Patent No.: US 9,516,723 B2
(45) Date of Patent: Dec. 6, 2016

(54) SYSTEM AND METHOD FOR DRIVING LIGHT EMITTING DIODES

(75) Inventors: Saijun Mao, Shanghai (CN); Yunfeng Liu, Shanghai (CN); Xiaoming Yuan, Shanghai (CN); Yingqi Zhang, Shanghai (CN); Charles Adrian Becker, Schenectady, NY (US); Junhui Fei, Shanghai (CN); Jian Wang, Shanghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 758 days.

(21) Appl. No.: 13/810,109

(22) PCT Filed: Jun. 14, 2011

(86) PCT No.: PCT/US2011/040312
§ 371 (c)(1),
(2), (4) Date: Jan. 14, 2013

(87) PCT Pub. No.: WO2012/009086
PCT Pub. Date: Jan. 19, 2012

(65) Prior Publication Data

US 2013/0119882 A1 May 16, 2013

(30) Foreign Application Priority Data

Jul. 14, 2010 (CN) ..... 2010 1 0229860

(51) Int. Cl.
*H05B 33/08* (2006.01)
*H05B 37/02* (2006.01)

(52) U.S. Cl.
CPC ..... *H05B 37/02* (2013.01); *H05B 33/0815* (2013.01); *H05B 33/0824* (2013.01)

(58) Field of Classification Search
CPC .. H05B 33/0815; H05B 37/02; H05B 33/0824
(Continued)

(56) References Cited

U.S. PATENT DOCUMENTS 3,619,716 A 11/1971 Spira
3,869,641 A 3/1975 Goldberg
(Continued)

FOREIGN PATENT DOCUMENTS

CN 1779749 A 5/2006
CN 1967994 A 5/2007
(Continued)

OTHER PUBLICATIONS

Menniti, "A cost effective ac voltage regulator to mitigate voltage sags and dim lamps in street lighting applications", May 16, 2010, IEEE, 2010 9th International Conference on Environment and Electrical Engineering (EEEIC), pp. 396-399.*
(Continued)

*Primary Examiner* — Tung X Le
*Assistant Examiner* — Raymond R Chai
(74) *Attorney, Agent, or Firm* — GE Global Patent Operation; Peter T. DiMauro

(57) ABSTRACT

A system having an alternating current (AC) driven LED unit, an AC voltage regulator, and a controller is provided. The AC driven LED unit includes a first LED and a second LED coupled in reverse parallel. The AC voltage regulator is operable to receive AC voltage originating from an AC voltage source, regulate the AC voltage according to control signals from the controller, and apply regulated AC voltage to the AC driven LED unit, so as to enable the first LED and the second LED to emit light according to the regulated AC voltage. In addition, a method is provided for driving the LED by regulating the AC voltage. By regulating the AC voltage using the AC voltage regulator, benefits of restraining voltage fluctuations, reducing THD, improving power factor, providing dimming control, and mitigating flicker phenomenon can be achieved.

20 Claims, 11 Drawing Sheets

(58) Field of Classification Search
USPC ..... 315/250
See application file for complete search history.

(56) References Cited

U.S. PATENT DOCUMENTS

| | | | | |
|---|---|---|---|---|
| 4,298,869 | A | 11/1981 | Okuno | |
| 4,939,426 | A | 7/1990 | Menard et al. | |
| 4,970,437 | A | 11/1990 | Stevens | |
| 5,099,410 | A | 3/1992 | Divan | |
| 5,936,599 | A | 8/1999 | Reymond | |
| 6,072,280 | A | 6/2000 | Allen | |
| 6,236,192 | B1 | 5/2001 | Suzuki et al. | |
| 6,326,773 | B1 | 12/2001 | Okuma et al. | |
| 6,359,392 | B1 | 3/2002 | He | |
| 6,461,019 | B1 | 10/2002 | Allen | |
| 6,703,818 | B2 | 3/2004 | Amels et al. | |
| 6,830,358 | B2 | 12/2004 | Allen | |
| 6,853,150 | B2 | 2/2005 | Clauberg et al. | |
| 6,909,258 | B2 | 6/2005 | Milazzotto et al. | |
| 6,972,528 | B2 | 12/2005 | Shao | |
| 7,009,199 | B2 | 3/2006 | Hall | |
| 7,038,399 | B2 | 5/2006 | Lys et al. | |
| 7,066,628 | B2 | 6/2006 | Allen | |
| 7,138,770 | B2 | 11/2006 | Uang | |
| 7,264,381 | B2 | 9/2007 | Liu et al. | |
| 7,344,275 | B2 | 3/2008 | Allen et al. | |
| 7,378,805 | B2 | 5/2008 | Oh et al. | |
| 7,489,086 | B2 | 2/2009 | Miskin et al. | |
| 7,564,198 | B2 | 7/2009 | Yamamoto et al. | |
| 7,646,153 | B2 | 1/2010 | Wake | |
| 7,701,149 | B2 | 4/2010 | Lin | |
| 7,705,543 | B2 | 4/2010 | Ragonesi et al. | |
| 8,238,112 | B2 | 8/2012 | Kim et al. | |
| 2003/0030423 | A1 | 2/2003 | Thoburn | |
| 2005/0225257 | A1 | 10/2005 | Green | |
| 2007/0273299 | A1* | 11/2007 | Miskin et al. | 315/250 |
| 2007/0278502 | A1 | 12/2007 | Shakuda et al. | |
| 2008/0116816 | A1 | 5/2008 | Neuman et al. | |
| 2008/0258647 | A1 | 10/2008 | Scianna | |
| 2008/0315684 | A1* | 12/2008 | Cheng et al. | 307/45 |
| 2009/0160370 | A1 | 6/2009 | Tai et al. | |
| 2009/0167203 | A1 | 7/2009 | Dahlman et al. | |
| 2009/0184662 | A1* | 7/2009 | Given et al. | 315/294 |
| 2009/0195168 | A1 | 8/2009 | Greenfeld | |
| 2009/0243582 | A1 | 10/2009 | Irissou et al. | |
| 2009/0261748 | A1 | 10/2009 | McKinney et al. | |
| 2009/0322241 | A1 | 12/2009 | Onushkin et al. | |
| 2010/0026208 | A1* | 2/2010 | Shteynberg | H05B 33/0815 315/297 |
| 2010/0060181 | A1 | 3/2010 | Choi et al. | |
| 2010/0090604 | A1 | 4/2010 | Maruyama et al. | |

FOREIGN PATENT DOCUMENTS

| | | | |
|---|---|---|---|
| CN | 20966169 | Y | 10/2007 |
| CN | 101281705 | A | 10/2008 |
| CN | 101614381 | A | 12/2009 |
| CN | 101621879 | A | 1/2010 |
| EP | 1942705 | A1 | 7/2008 |
| JP | 2000354376 | A | 12/2000 |
| JP | 2002008409 | A | 1/2002 |
| JP | 2002049429 | A | 2/2002 |
| JP | 2006311726 | A | 11/2006 |
| JP | 2009088482 | A | 4/2009 |
| JP | 2010097877 | A | 4/2010 |
| WO | 2004023568 | A1 | 3/2004 |
| WO | 2005084080 | A2 | 9/2005 |
| WO | 2006129291 | A2 | 12/2006 |
| WO | 2007001116 | A1 | 1/2007 |
| WO | 2007018360 | A1 | 2/2007 |
| WO | 2007018390 | A1 | 2/2007 |
| WO | 2008038918 | A1 | 4/2008 |
| WO | 2009139550 | A2 | 11/2009 |
| WO | 2010035155 | A2 | 4/2010 |

OTHER PUBLICATIONS

CN Office Action dated Sep. 3, 2013 from corresponding CN Application No. 201010229860.4 along with unofficial English translation.

International Search Report dated Sep. 30, 2011 which was issued in connected with PCT Application No. US11/40312 which was filed on Jun. 14, 2011.

Menniti et. al.: "A cost effective AC voltage regulator to mitigate voltage sags and dim lamps in street-lighting applications.", Environment and Electrical Engineering (EEEIC), 2010 9th International Conference on, IEEE, Piscataway, NJ, USA, May 16, 2010 (pp. 396-399, XPO31693218, ISBN: 978-1-4244-5370-2 the whole document.

Nan-Sup Choi et. al.: "Dynamic voltage restorer using PWM ac-ac converter", 2010 International Power Electronics Conference: IPEC-SAPPORO 2010-[ECCE ASIA]; Sapporo, Japan IEEE, Piscataway, NJ USA; Jun. 21, 2010, pp. 2690-2695, XPO31727803, ISBN: 978-1-4244-5394-8.

Flores-Arias: "Transformerles power line voltage conditioner and regulator baed on CA PWM Chopper", Indstrial Electronc 2010 IEEE Internationl Sysmposium on Jul. 4, 2010 pp. 3304-3307.

Unofficial English translation of Japanese Office Action issued in connection with corresponding JP Application No. 2013-519692 on Feb. 10, 2015.

Unofficial English Translation of Chinese Office Action issued in connection with corresponding CN Application No. 201010229860.4 on Mar. 17, 2014.

Andreycak, "Zero Voltage Switching Resonant Power Conversion", UNITRODE, SLUA159, pp. 1-28, Sep. 1999.

Caceres et al., "A Boost DC-AC Converter: Analysis, Design, and Experimentation", IEEE Transactions on Power Electronics, vol. No. 14, Issue No. 1, pp. 134-141, Jan. 1999.

William et al., "Dynamic Sag Correctors: Cost-Effective Industrial Power Line Conditioning", IEEE Transactions on Industry Applications, vol. No. 37, Issue No. 1, Jan./Feb. 2001.

Viktorin et al., "The Prototype of a Single-Phase Dynamic Voltage Restorer", Proceedings of 11th International Power Electronics and Motion Control Conference, Riga, Letland, pp. 1-5, 2004.

Banerjee et al., "AC Voltage Regulation by Switch Mode Buck-Boost Voltage Controller", 3rd International Conference on Electrical & Computer Engineering, Dhaka, Bangladesh, pp. 351-354,Dec. 2004.

Steval-IHM006V1, "AC/AC chopper Driver", pp. 1-5, Jul. 20, 2007.

Aurasopon et al., "Resonant DC Link in PWM AC Chopper", World Academy of Science, Engineering and Technology, Issue No. 32, pp. 101-105, 2009.

European Office Action issued in connection with corresponding EP Application No. 11726311.1 on Jul. 20, 2015.

* cited by examiner

SYSTEM AND METHOD FOR DRIVING LIGHT EMITTING DIODES

BACKGROUND

Embodiments of the invention relate generally to systems and methods for driving light emitting diodes.

A light emitting diode (LED) is a photoelectric conversion device, which is operable to emit light in response to electrical current or voltage supplied thereto. Generally, the LED has an N-type semiconductor and a P-type semiconductor joined together. The LED emits light through recombination of electrons and holes. Such an LED is widely used for signaling, traffic light, backlighting, and general illumination due to its high efficacy, energy saving, environmental friendliness and long lifetime.

When the LED is directly connected to an AC voltage source, the LED may not continuously emit light in a full cycle. To solve this problem, a LED that can be used while being connected directly to an AC voltage source has been disclosed in PCT patent application publication No. WO2004/023568A1, entitled "Light-emitting device having light-emitting elements" by Sakai et al. According to the disclosure of Sakai et al., two LED arrays are connected to each other in reverse parallel. One LED array operates in a first half cycle (or positive half cycle) of an AC voltage source, and the other LED array operates in a second half cycle (or negative half cycle) of the AC voltage source.

As disclosed by Sakai et al., the two LED arrays alternately cycle on and off in response to a phase change of an AC voltage source. This results in some operating issues for the LED. The first is that when the AC voltage from the AC voltage source fluctuates, the current flowing through the LED changes accordingly. Thus, stable and constant brightness of the LED may not be obtained. The second is a poor power factor and total harmonic distortion (THD) because the LED begins to emit light only when the AC voltage exceeds a threshold voltage. The third is that it's difficult to perform dimming control of the LED in some applications. The fourth relates to the flicker phenomenon, which although not observable with the naked eye, will cause eye fatigue if the LEDS are used for illumination for a long period of time.

It is desirable to provide system and method of driving the light emitting diodes to address the above-mentioned problems.

BRIEF DESCRIPTION

In accordance with one embodiment disclosed herein, a system is provided for driving light emitting diodes (LED). The system includes an AC driven LED unit, an AC voltage regulator, and a controller. The AC driven LED unit includes a first LED and a second LED. The first LED and the second LED are coupled in reverse parallel. The AC voltage regulator is coupled to the AC driven LED unit and the controller. The AC voltage regulator is operable to receive AC voltage originating from an AC voltage source. The controller is operable to monitor AC voltage fluctuations and transmit control signals to the AC voltage regulator according to a monitored result. The AC voltage regulator is further operable to regulate the AC voltage from the AC voltage source in response to the control signals and to apply a regulated AC voltage to the AC driven LED unit so as to allow the first LED and the second LED to emit light according to the regulated AC voltage.

In accordance with another embodiment disclosed herein, a system is provided for driving an alternating current (AC) driven LED unit with an AC voltage originating from an AC voltage source. The AC driven LED unit includes a first LED and a second LED arranged in reverse parallel. The system includes an alternating current voltage regulator and a phase-cut dimming circuit. The AC voltage regulator is operable to receive the AC voltage originating from the AC voltage source, and to modulate the received AC voltage with pulse signals. A magnitude of the modulated AC voltage is capable of being adjusted by varying a duty cycle of the pulse signals to achieve a first dimming control of the first LED and the second LED. The phase-cut dimming circuit is coupled to the AC voltage regulator. The phase-cut dimming circuit is operable to change a conduction angle of the received AC voltage to achieve a second dimming control of the first LED and the second LED.

In accordance with one embodiment disclosed herein, a method is provided for driving an AC driven LED unit. The AC driven LED unit includes a first LED and a second LED. The first LED and the second LED are coupled in reverse parallel. The method includes at least the following steps of: receiving AC voltage originating from an AC voltage source; monitoring fluctuations of a received AC voltage by a controller; regulating the received AC voltage based on the monitored fluctuations of the received AC voltage by an AC voltage regulator; and applying the regulated AC voltage to the AC driven LED unit to drive the first LED and the second LED to emit light.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
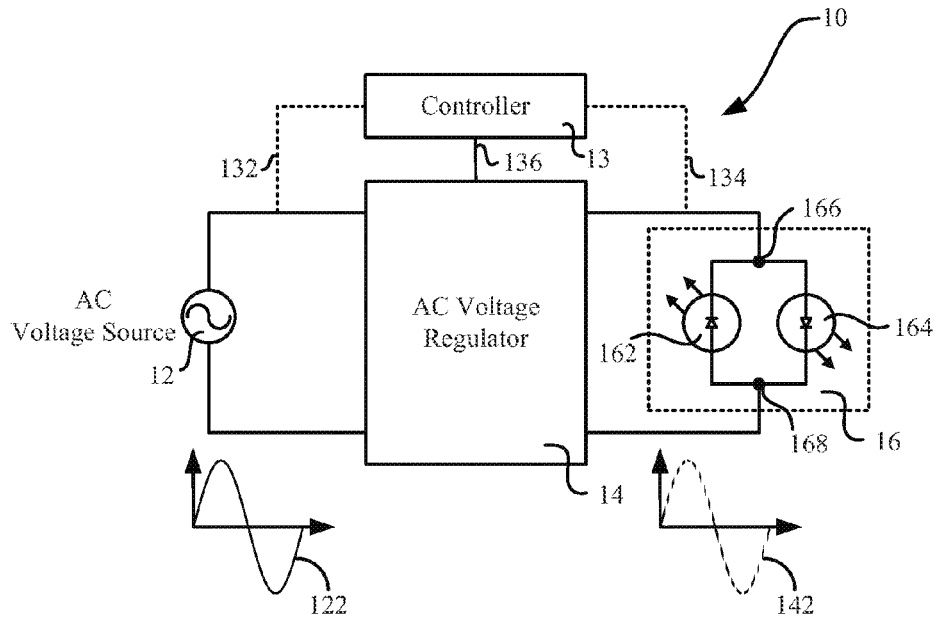
FIG. 1 is a schematic circuit diagram of a system for driving light emitting diodes in accordance with one embodiment.

Embodiments of the disclosure relate to a system and method for driving light emitting diodes (LED). Unless defined otherwise, technical and scientific terms used herein have the same meaning as is commonly understood by one of ordinary skill in the art to which this invention belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced items, and terms such as "front", "back", "bottom", and/or "top", unless otherwise noted, are merely used for convenience of description, and are not limited to any one position or spatial orientation. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum. Some examples of LEDs include, but are not limited to, various types of infrared LEDs, ultraviolet LEDs, red LEDs, blue LEDs, green LEDs, yellow LEDs, amber LEDs, orange LEDs, and white LEDs. It also should be appreciated that LEDs may be configured to generate radiation having various bandwidths for a given spectrum (e.g., narrow bandwidth, broad bandwidth).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

FIG. 1 illustrates a system for driving LEDs according to one embodiment. Referring to FIG. 1, a system 10 includes an AC voltage source 12, a controller 13, an AC voltage regulator 14, and an AC driven LED unit 16. In the illustrated embodiment, the AC voltage regulator 14 is electrically coupled to the AC voltage source 12 and the controller 13. The AC voltage regulator 14 is configured to receive an AC voltage 122 from the AC voltage source 12. The AC voltage 122 from the AC voltage source 12 may be a 60 Hz sinusoidal 110 VAC to 125 VAC signal as is typically found in the United States. In other embodiments, the supplied frequency and magnitude of the AC voltage 122 may vary, dependent on the power standards of the region. For example, in some embodiments, the AC voltage 122 may be a 50 Hz, sinusoidal 220 VAC signal as is typically found in the China.

The AC voltage regulator 14 is further configured to perform a direct AC-AC power conversion with respect to the received AC voltage 122, and provide a regulated AC voltage 142. As used herein, "direct AC-AC power conversion" refers to a condition such that when the original AC voltage 122 from the AC voltage source 12 is a true sinusoidal signal, the regulated AC voltage 142 will also substantially be sinusoidal signal. It will be understood that the AC voltage regulator 14 may regulate waveforms of the AC voltage 122 in any shape. For example, the AC voltage 122 may include sine waves, triangular waves, square waves, or step function waves.

In one implementation, the AC voltage regulator 14 may be configured to receive the AC voltage 122 from the AC voltage source 12, and regulate the received AC voltage 122 according to required current flowing through the AC driven LED unit 16 or according to required voltage applied to the AC driven LED unit 16. The required current and required voltage may be preconfigured in the controller 13. In operation, the controller 13 may be programmed to transmit corresponding control signals 136 to the AC voltage regulator 14 to enable the AC voltage regulator 14 to provide the regulated AC voltage 142 at a predetermined level corresponding to the required current or the required voltage. The predetermined level of the regulated AC voltage 142 may be the same as or different from that of the AC voltage 122.

In one implementation, as indicated by dashed line 132 shown in FIG. 1, the controller 13 may be coupled to the AC voltage source side to provide feedback control in a first manner. When the controller 13 is coupled to the AC voltage source side, the controller 13 is configured to monitor the AC voltage 122 from the AC voltage source 12. When the AC voltage 122 fluctuates, the controller 13 provides control signals indicating the fluctuations of the AC voltage 122. In response, the AC voltage regulator 14 regulates the AC voltage 122 according to the control signals to maintain the regulated AC voltage 142 at a predetermined level.

In another implementation, as indicated by dashed line 134 shown in FIG. 1, the controller 13 may be coupled to the AC driven LED side to provide feedback control in a second manner. When the controller 13 is coupled to the AC driven LED side, the controller 13 is configured to monitor the regulated AC voltage 142 provided by the AC voltage regulator 14. When the regulated AC voltage 142 fluctuates, the controller 13 provides control signals indicating the fluctuations of the regulated AC voltage 142. In response, the AC voltage regulator 14 regulates the AC voltage 122 according to the control signals to maintain the regulated voltage 142 at a predetermined level. It should be noted that, in other embodiments, the controller 13 may be coupled both to the AC voltage source side and the AC driven LED side to provide feedback control by monitoring both the AC voltage 122 and the regulated AC voltage 142.

In the illustrated embodiment of the system 10, the AC driven LED unit 16 includes a first LED 162 and a second LED 164. The first LED 162 and the second LED 164 are coupled in reverse parallel between a first node 166 and a second node 168. More specifically, the first LED 162 is arranged between the first node 166 and the second node 168 along a first path, and the second LED 164 is arranged between the first node 166 and the second node 168 along a second path. It should be understood that, in other embodiments, more than one first LED 162 may be connected in series between the first node 166 and the second node 168 along the first path. In other embodiments, more than one second LED 164 may be connected in series between the first node 166 and the second node 168 along the second path. In these embodiments, the first path and the second path may be arranged with LED arrays.

In the illustrated embodiment of the system 10, the AC voltage source 12 is shown as a part of the system 10. It should be noted that, in other embodiments, the AC voltage source 12 may be configured as a removable portion of the system 10. In this condition, the system 10 can be constructed so as to not include the AC voltage source 12.

In the illustrated embodiment of the system 10, the AC voltage source 12 and the AC voltage regulator 14 are directly coupled. As will be understood by those skilled in the art, a variety of other electrical elements or components may be added to the system 10. For example, a switch (either mechanical or electrical type) may be coupled between the AC voltage source 12 and the AC voltage regulator 14 for enabling or disabling the system 10 by controlling the switch. It should also be understood that a transformer may be further coupled following the AC voltage source 12 for stepping up or down the AC voltage 122 from the AC voltage source 12 according to specific requirements.

In the illustrated embodiment of the system 10, the controller 13 and the AC voltage regulator 14 are shown as independent elements for description. It should be understood that the controller 13 and the AC voltage regulator 14 may be integrated together as a single element, e.g. a semiconductor chip. The AC voltage regulator 14 and the controller 13 may be implemented in a variety of ways, such as in analog or digital hardware or software, or combinations thereof, as well as other structurally equivalent forms known to those skilled in the art.

In operation of the system 10, the AC voltage source 12 may output an AC voltage 122 having sinusoidal waveform. When the AC voltage 122 fluctuates, for example, the AC voltage 122 may swell. The controller 13 may sense swelling of the AC voltage 122 and provide a control signal reflecting the swelling to the AC voltage regulator 14. The AC voltage regulator 14 regulates the AC voltage 122 to reduce a magnitude of the regulated AC voltage 142 according the control signal, such that the voltage level of the regulated AC voltage 142 is maintained at a predetermined level. The first LED 162 and the second LED 164 alternates emitting light according to the regulated AC voltage 164. Because the regulated AC voltage 142 is maintained substantially at a predetermined level, constant brightness of the first LED 162 and the second LED 164 can be achieved.

Figure 2:
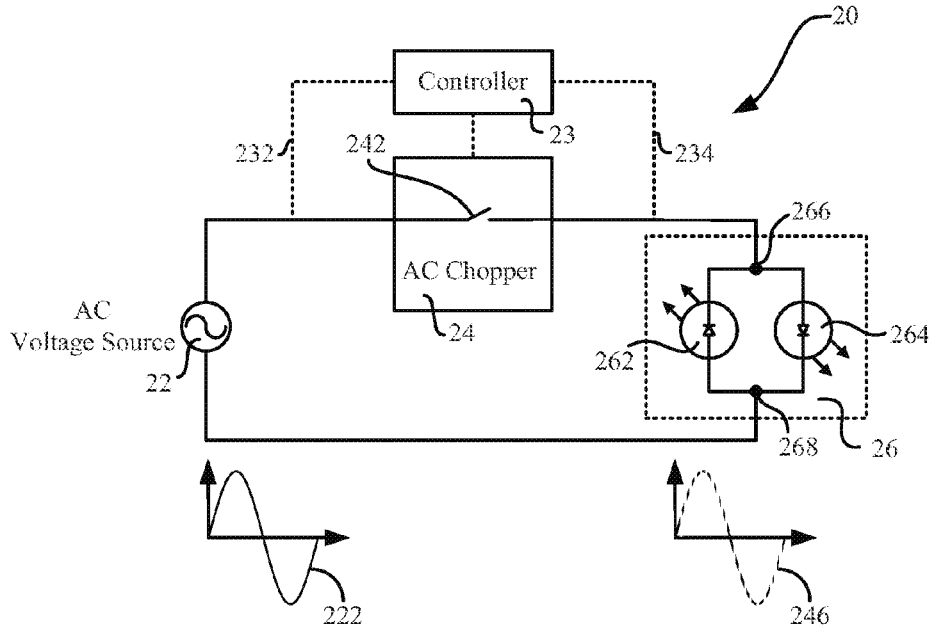
FIG. 2 is a schematic circuit diagram of a system for driving light emitting diodes in accordance with another embodiment.

FIG. 2 illustrates a system in accordance with another embodiment. Referring to FIG. 2, a system 20 includes an AC voltage source 22, a controller 23, an AC chopper 24, and an AC driven LED unit 26. The controller 23, the AC voltage source 22, and the AC driven LED unit 26 are substantially the same as those shown in FIG. 1, thus, for the purpose of simplicity, a detailed description of the AC voltage source 22, the controller 23, and the AC driven LED unit 26 are omitted here. For example, the controller 23 may be either coupled to the AC voltage source side by a first electrical connection 232 or the AC driven LED side by a second electrical connection 234 to provide feedback control.

In the illustrated embodiment of the system 20, the AC chopper 24 includes a switch 242. A first terminal of the switch 242 is electrically coupled to one terminal of the AC voltage source 22, a second terminal of the switch 242 is electrically coupled to the AC driven LED unit 26, and a third terminal of the switch 242 is electrically coupled to the controller 23. The switch 242 is turned on and off in response to control signals transmitted from the controller 23 for modulating the AC voltage 222. In particular, the switch 242 is configured for chopping at least a portion of the AC voltage 222 from the AC voltage source 22. As used herein, "chopping" refers to an electrical operation with respect to the AC voltage 222 for adjusting a magnitude thereof. By such an electrical operation, at a predetermined time interval, the AC voltage 222 is prohibited from being transferred to the AC driven LED unit 26.

Figure 3:
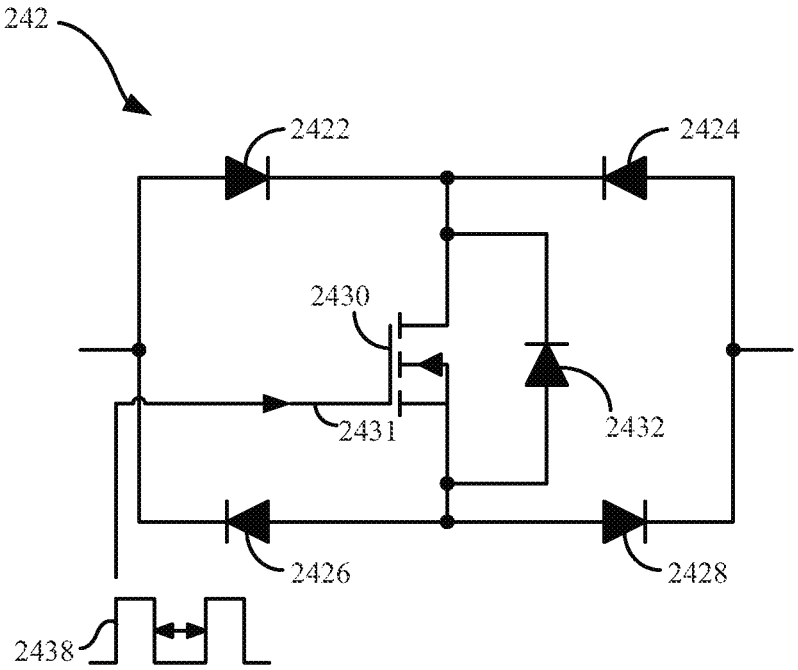
FIG. 3 is a detailed circuit construction of a switch of the system illustrated in FIG. 2 in accordance with one embodiment.

FIG. 3 illustrates one embodiment of the switch 242 illustrated in FIG. 2. Referring to FIG. 3, the switch 242 is constructed as a bidirectional switch. As used herein, "bidirectional" refers to a condition such that when the switch 242 is switched on, both positive cycles and negative cycles of the AC voltage 222 can pass through the switch 242. In particular, the switch 242 may be a semiconductor switch for ease of manufacturing and integrating purposes. The switch 242 includes a switching element 2430, a protection diode 2432, and four diodes 2422, 2424, 2426, and 2428. As shown in FIG. 3, the switching element 2430 is a metal-oxide-semiconductor field-effect transistor (MOSFET). It should be understood that any suitable switching components that can be controllably turned on and off (e.g., IGBT, BJT, etc.) may be utilized in the present disclosure. The switching element 2430 is coupled between two opposed nodes of a bridge diode circuit constructed by the four diodes 2422, 2424, 2426, and 2428. The protection diode 2432 is coupled in parallel to the switching element 2430 for protecting the switching element 2430. A gate terminal 2431 of the switching element 2430 (or the MOSFET) is configured to receive pulse signals 2438. The pulse signals 2438 may be unipolar signals (positive relative to ground), and can be provided by the controller 23. The switching element 2430 (or the MOSFET) is turned on and off in response to the pulse signals 2438. Herein, a proportion of time during which the switching element 2430 is switched on can be defined as "duty cycle". By varying the duty cycle of the pulse signals 2438, the voltage level of the regulated AC voltage 246 can be adjusted according to predetermined requirements, which may be referred to as dimming control. Details of the dimming control will be described hereinafter.

Figure 4:
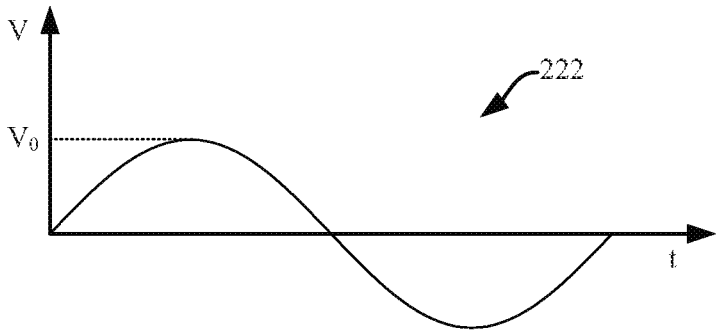
FIG. 4 illustrates a waveform of an AC voltage originating from the AC voltage source illustrated in FIG. 2 in accordance with one embodiment.
Figure 5:
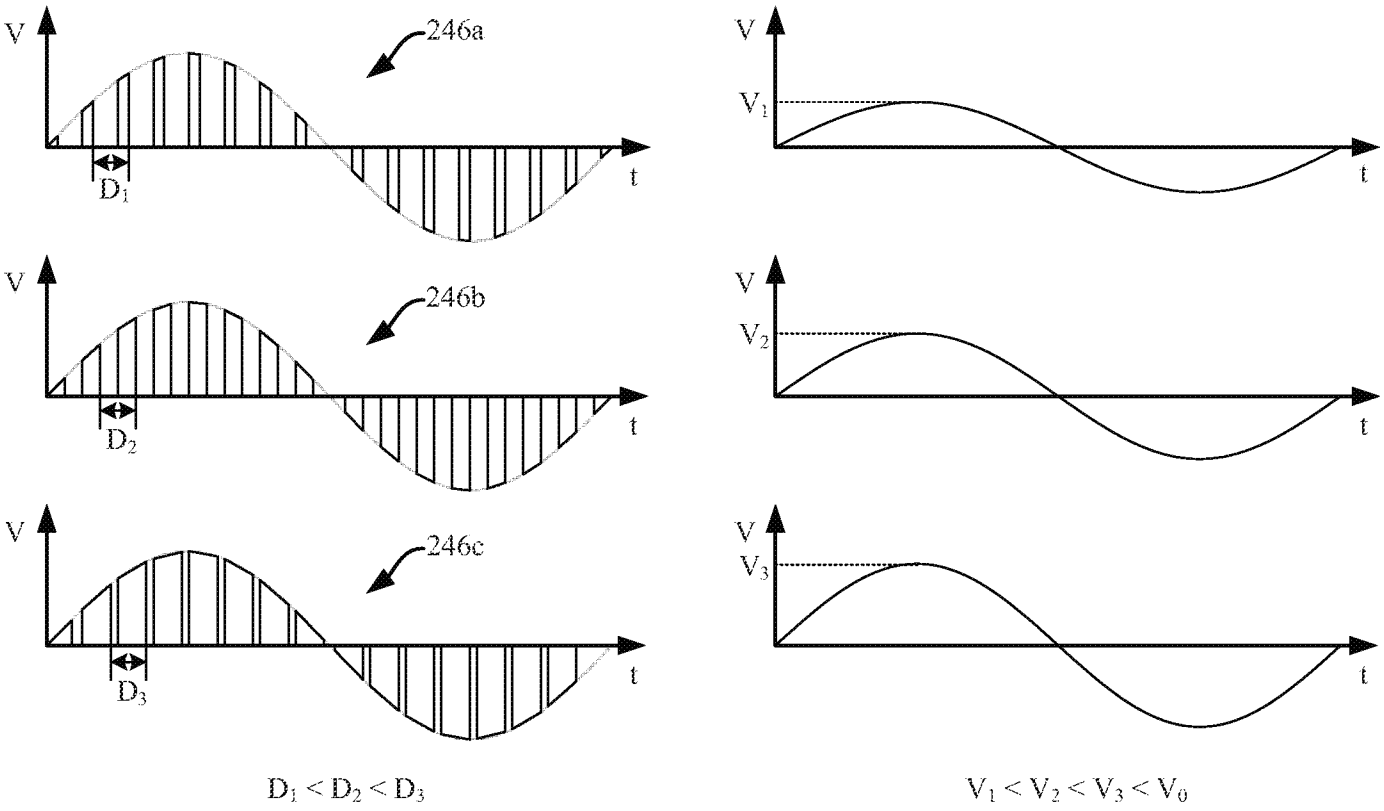
FIG. 5 illustrates various waveforms of regulated AC voltage from the AC chopper illustrated in FIG. 2 in accordance with one embodiment.

Referring to FIG. 4, a waveform of the AC voltage 222 is illustrated. The AC voltage 222 is a sinusoidal signal having a peak voltage value of $V_0$. Further referring to FIG. 5, various waveforms of regulated AC voltage 246*a*, 246*b*, and 246*c* are illustrated to indicate how the varying duty cycles are related to different voltage levels. For example, as shown in FIG. 5, when the AC voltage 222 is regulated according to the pulse signals 2438 having a duty cycle of $D_1$, the regulated AC voltage 246*a* has a peak voltage value of $V_1$, wherein $V_1$ is smaller than $V_0$. When the AC voltage 222 is regulated according to the pulse signals 2438 having a duty cycle of $D_2$, the regulated AC voltage 246*b* has a peak voltage value of $V_2$, wherein $V_2$ is larger than $V_1$ and smaller than $V_0$. When the AC voltage 222 is regulated according to the pulse signals 2438 having a duty cycle of $D_3$, the regulated AC voltage 246*c* has a peak voltage value of $V_3$, wherein $V_3$ is greater than $V_2$ and smaller than $V_0$. Thus, when the regulated AC voltage 246*a*, 246*b*, and 246*c* are applied to the AC driven LED unit 26, the AC driven LED unit 26 emits light with varying brightness. Therefore, by varying the duty cycle of the pulse signals 2438, a voltage level of the regulated AC voltage can be specified according to predetermined requirements. Hence, a dimming control of the AC driven LED unit 26 can be realized.

Figure 6:
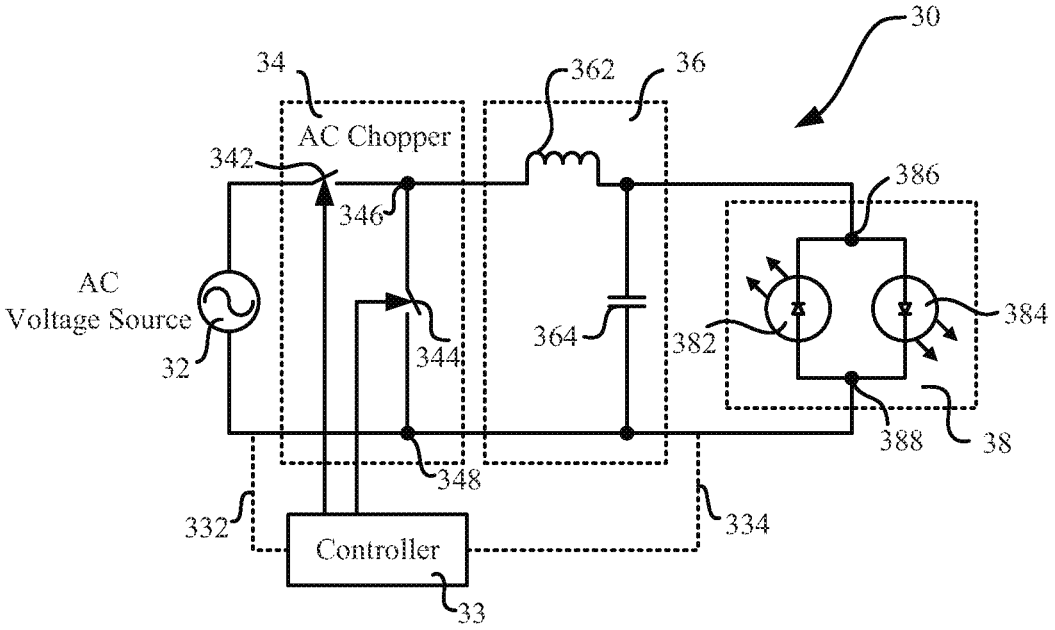
FIG. 6 is a schematic circuit diagram of a system for driving light emitting diodes in accordance with yet another embodiment.

FIG. 6 illustrates a system according to yet another embodiment. Referring to FIG. 6, a system 30 includes an AC voltage source 32, a controller 33, an AC chopper 34, a filter circuit 36, and an AC driven LED unit 38. The AC voltage source 32, the controller 33, and the AC driven LED unit 38 are substantially the same as those shown in FIG. 1 and FIG. 2, thus, for the purpose of simplicity, a detailed description of the AC voltage source 32, the controller 33, and the AC driven LED unit 38 are omitted here. For example, the controller 33 may be either coupled to the AC voltage source side by a first electrical connection 332 or the AC driven LED side by a second electrical connection 334 to provide feedback control.

In the illustrated embodiment of the system 30, the AC chopper 34 and the filter circuit 36 are connected in series between the AC voltage source 32 and the AC driven LED unit 38. Basically, the AC chopper 34 functions substantially the same as the AC chopper 24 of FIG. 2. The AC chopper 34 is configured to perform direct AC-AC conversion with respect to AC voltage received from the AC voltage source 32, chopping out at least a portion of the received AC voltage from the AC voltage source 32. The AC chopper 34 may respond to pulse signals transmitted from the controller 33 so as to provide regulated AC voltage with adjusted voltage level. The filter circuit 36 is configured to filter high frequency noise signals generated by the AC chopper 34 of the system 30.

In one implementation, the AC chopper 34 includes a first switch 342 and a second switch 344. The filter circuit 36 includes an inductor 362 and a capacitor 364. The inductor 362 and the capacitor 364 cooperate to filter high frequency noise signals generated by switching operations of the first switch 342 and the second switch 344. The first switch 342 and the inductor 362 are connected in series to one terminal of the AC voltage source 32 and a first node 386 of the AC driven LED unit 38. The second switch 344 is coupled between a first node 346 and a second node 348. The first node 346 is a joint connection of one terminal of the first switch 342 and one terminal of the inductor 362. The second node 348 is joint connection of the other terminal of the AC voltage source 32 and one terminal of the capacitor 364. The other terminal of the capacitor 364 is coupled to the other terminal of the inductor 362 also to the first node 386 of the AC driven LED unit 38.

Figure 7:
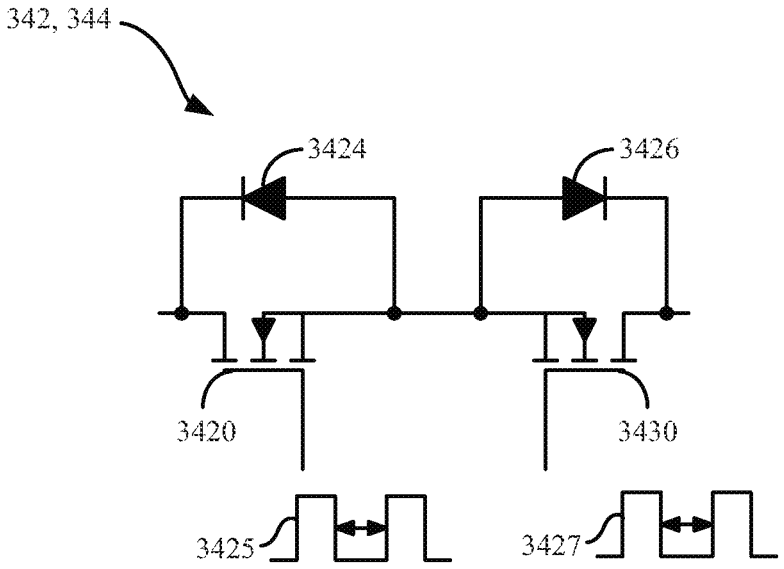
FIG. 7 is a detailed circuit construction of switches of the system illustrated in FIG. 6 in accordance with one embodiment.

FIG. 7 illustrates one embodiment of a bidirectional switch suitable for use as the first switch 342 and the second switch 344 of FIG. 6. In the illustrated embodiment, each of the bidirectional switches 342, 344 includes a first switching element 3420 and a second switching element 3430. The first switching element 3420 is parallel coupled with a first diode 3424. The second switching element 3430 is parallel coupled with a second diode 3426. The first diode 3424 and the second diode 3426 are configured to protect the first switching element 3420 and the second switching element 3430 respectively. As shown in FIG. 7, the first switching element 3420 and the second switching element 3430 are MOSFET devices. It should be understood, however, that any suitable switching components that can be controllably turned on and off (e.g., IGBT, BJT, etc.) may be utilized in the present disclosure.

In one embodiment, the first switch 342 and the second switch 344 are configured to operate in a complementary manner. That is, when the first switch 342 is turned on, the second switch 344 is substantially turned off. When the first switch 342 is turned off, the second switch 344 is substantially turned on. Zero voltage switching can be realized by operating the first switch 342 and the second switch 344 in a complementary manner, thereby, high efficiency of the system 30 can be achieved. Similar to the system 20, the first switch 342 and the second switch 344 are turned on and off by supplying pulse signals 3425, 3427 thereto. Hence, by varying a duty cycle of the pulse signals 3425, 3427 supplied to the first switch 342 and the second switch 344, a dimming control of the AC driven LED unit 36 can also be realized.

Figure 8:
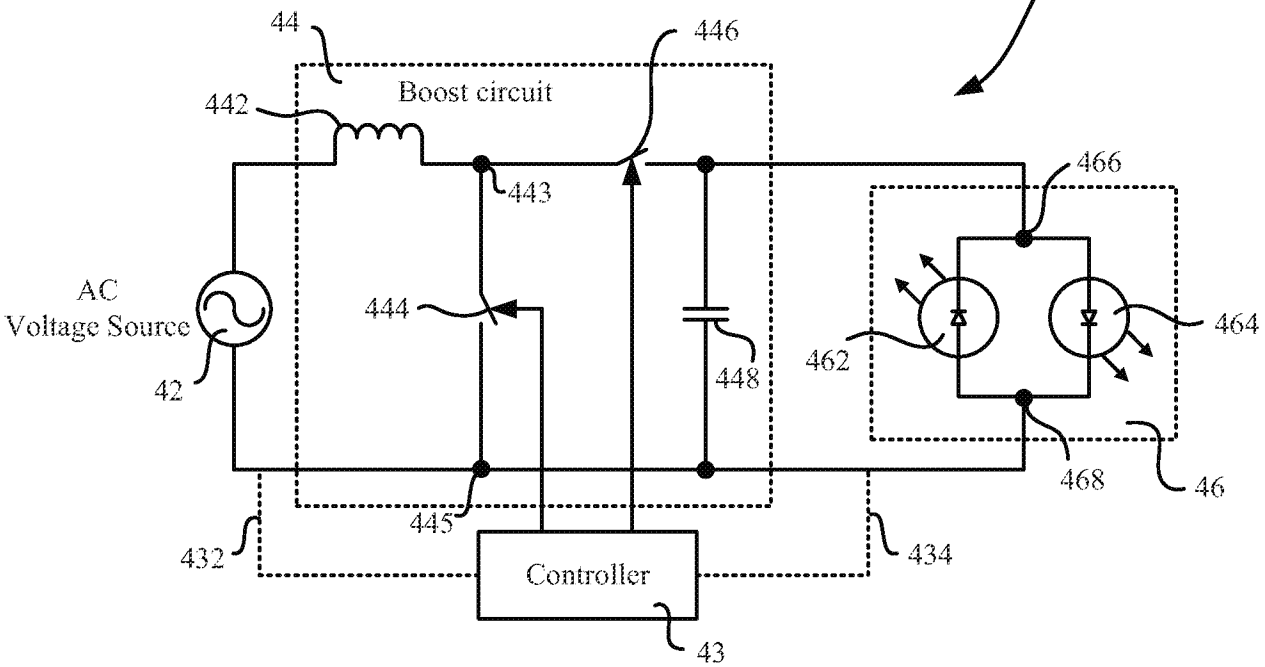
FIG. 8 is a schematic circuit diagram of a system for driving light emitting diodes in accordance with still another embodiment.

FIG. 8 illustrates a system in accordance with still another embodiment. Referring to FIG. 8, a system 40 includes an AC voltage source 42, a controller 43, a boost circuit 44, and an AC driven LED unit 46. The AC voltage source 42, the controller 43, and the AC driven LED unit 46 are substantially the same as those shown in FIG. 1, FIG. 2, and FIG. 6, and thus, for the purpose of simplicity, a detailed description of the AC voltage source 42, the controller 43, and the AC driven LED unit 46 are omitted here. For example, the controller 43 may be either coupled to the AC voltage source side by a first electrical connection 432 or the AC driven LED side by a second electrical connection 434 to provide feedback control.

In the illustrated embodiment of the system 40, the boost circuit 44 is coupled to the AC voltage source 42, the controller 43, and the AC driven LED unit 46. In general, in addition to performing a direct AC-AC conversion with respect to the AC voltage from the AC voltage source 42, the boost circuit 44 also boosts the AC voltage. That is, the AC voltage provided by the boost circuit 44 is greater than the AC voltage received by the boost circuit 44.

The boost circuit 44 includes an inductor 442, a first switch 444, a second switch 446, and a capacitor 448. The inductor 442 and the second switch 446 are connected in series between one terminal of the AC voltage source 42 and a first node 466 of the AC driven LED unit 46. The first switch 444 is coupled between a first node 443 and a second node 445. The first node 443 is a joint connection of one terminal of the inductor 442 and one terminal of the second switch 446. The second node 445 is a joint connection of one terminal of the capacitor 464 and the other terminal of the AC voltage source 42. The other terminal of the capacitor 464 is coupled to the first node 466 of the AC driven LED unit 46.

In the illustrated embodiment of the system 40, the first switch 444 and the second switch 446 can be constructed in the same manner as bidirectional switches which can be found in the system 30 of FIG. 6. Furthermore, the first switch 444 and the second switch 446 are configured to operate in a complementary manner. Similar to the system 30, the first switch 444 and the second switch 446 are turned on and off by supplying pulse signals thereto. Hence, by varying a duty cycle of the pulse signals supplied to the first switch 444 and the second switch 446, a dimming control of the AC driven LED unit 46 can also be realized.

Figure 9:
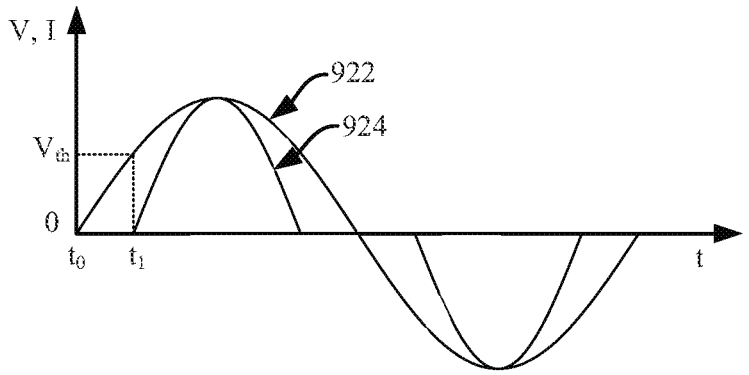
FIG. 9 illustrates a voltage waveform and a corresponding current waveform for driving a conventional light emitting diode.

Referring to FIG. 9, a voltage waveform 922 and a corresponding current waveform 924 for one full cycle in a conventional LED are plotted. During the positive half cycle, the voltage across the LED rises from zero volts at time $t_0$, to positive threshold value $V_{th}$ at time $t_1$. The current remains zero ampere from time $t_0$ to $t_1$, because the voltage across the LED falls below the threshold value $V_{th}$. The current starts to flow through the LED once the voltage surpasses the threshold value $V_{th}$.

Figure 10:
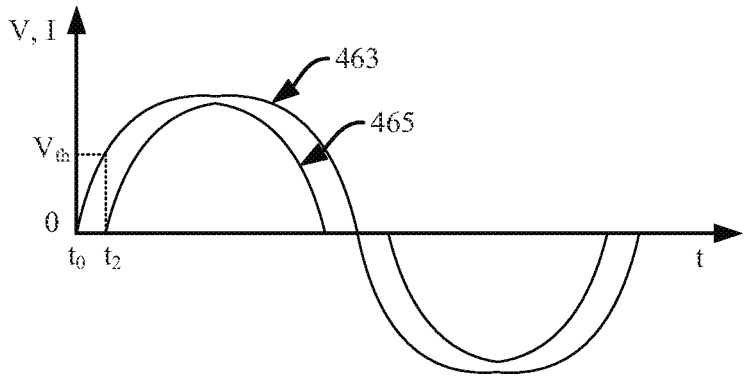
FIG. 10 illustrates a voltage waveform and a corresponding current waveform for driving the light emitting diodes shown in FIG. 8 in accordance with one embodiment.

Referring to FIG. 10, a voltage waveform 463 and a corresponding current waveform 465 for one full cycle in the second LED 464 of the system 40 are plotted. Because the AC voltage from the AC voltage source 42 is boosted by the boost circuit 44, the voltage across the second LED 464 rises to the threshold voltage $V_{th}$ at time $t_2$, wherein $t_2$ is smaller than $t_1$. Compared to conventional LEDs, because $t_2$ is smaller than $t_1$, it takes less time for the second LED 464 to conduct, and thus, the power factor can be improved and the total harmonic distortion (THD) of current can be reduced. Furthermore, during a full cycle, the light emission time of the second LED 464 as well as the first LED 462 is prolonged, such that a flicker phenomenon of the second LED 464 as well as the first LED 462 can be mitigated. It should be understood that, in other embodiments, the boost circuit 44 may be configured to double a frequency of the current in each half cycle of the AC voltage. As such, the flicker phenomenon of the second LED 464 as well as the first LED 462 can be further mitigated.

Figure 11:
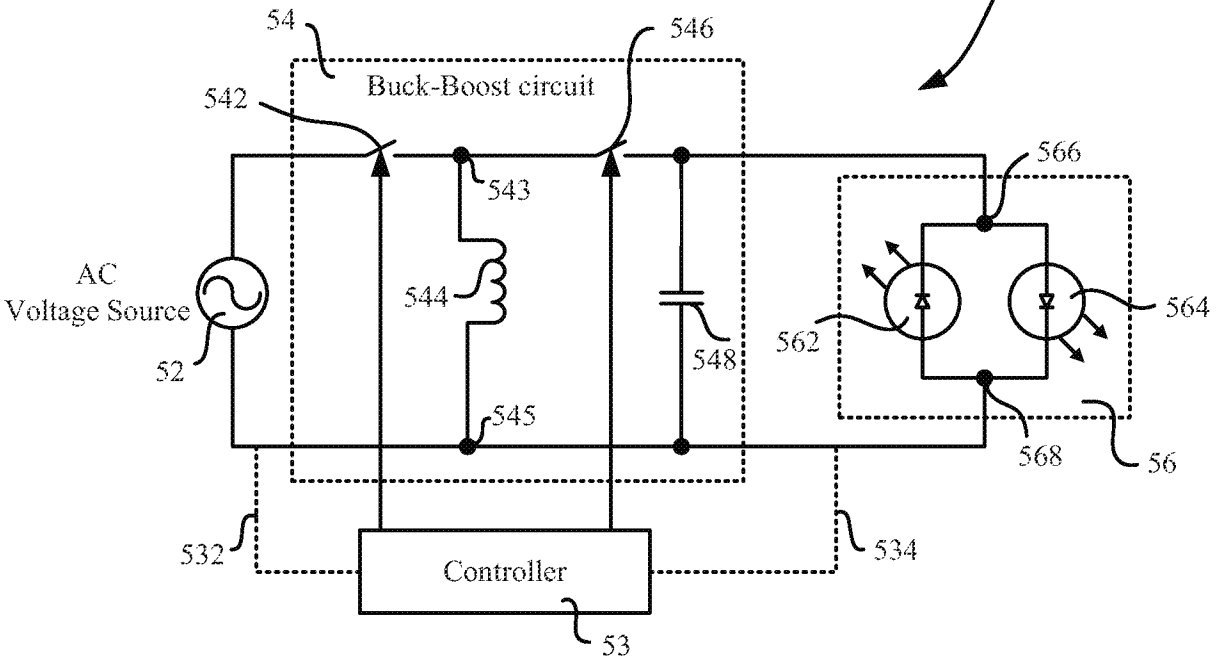
FIG. 11 is a schematic circuit diagram of a system for driving light emitting diodes in accordance with still another embodiment.

Referring to FIG. 11, a system 50 in accordance with still another embodiment is shown. In the illustrated embodiment, the system 50 includes an AC voltage source 52, a controller 53, a buck-boost circuit 54, and an AC driven LED unit 56. The AC voltage source 52, the controller 53, and the AC driven LED unit 56 are substantially the same as those shown in FIG. 1, FIG. 2, FIG. 6, and FIG. 8, and thus, for the purpose of simplicity, a detailed description of the AC voltage source 52, the controller 53, and the AC driven LED unit 56 are omitted here. For example, the controller 53 may be either coupled to the AC voltage source side by a first electrical connection 532 or the AC driven LED side by a second electrical connection 534 to provide feedback control.

In the illustrated embodiment of the system 50, the buck-boost circuit 54 is coupled between the AC voltage source 52 and the AC driven LED unit 56. The buck-boost circuit 54 is configured to receive the AC voltage from the AC voltage source 52, and either buck or boost the AC voltage. That is, the AC voltage output from the buck-boost circuit 54 can be smaller than or greater than the AC voltage received by the buck-boost circuit 54. The buck-boost circuit 54 includes a first switch 542, an inductor 544, a second switch 546, and a capacitor 548. The first switch 542 and the second switch 546 are connected in series between one terminal of the AC voltage source 52 and a first node 566 of the AC driven LED unit 56. The inductor 544 is coupled between a first node 543 and a second node 545. The first node 543 is a joint connection of one terminal of the first switch 542 and one terminal of the second switch 546 The second node is a joint connection of the other terminal of the AC voltage source 52 and one terminal of the capacitor 548. The other terminal of the capacitor 548 is coupled to the first node 566 of the AC driven LED unit 56.

In the illustrated embodiment of the system 50, the first switch 542 and the second switch 546 can be constructed in the same manner as bidirectional switches similar to those found in the system 30 of FIG. 6. Furthermore, the first switch 542 and the second switch 546 are configured to operate in a complementary manner. Similar to the system 30, the first switch 542 and the second switch 546 are turned on and off by supplying pulse signals thereto. Hence, by varying a duty cycle of the pulse signals supplied to the first switch 542 and the second switch 546, a dimming control of the AC driven LED unit 56 can also be realized.

Figure 12:
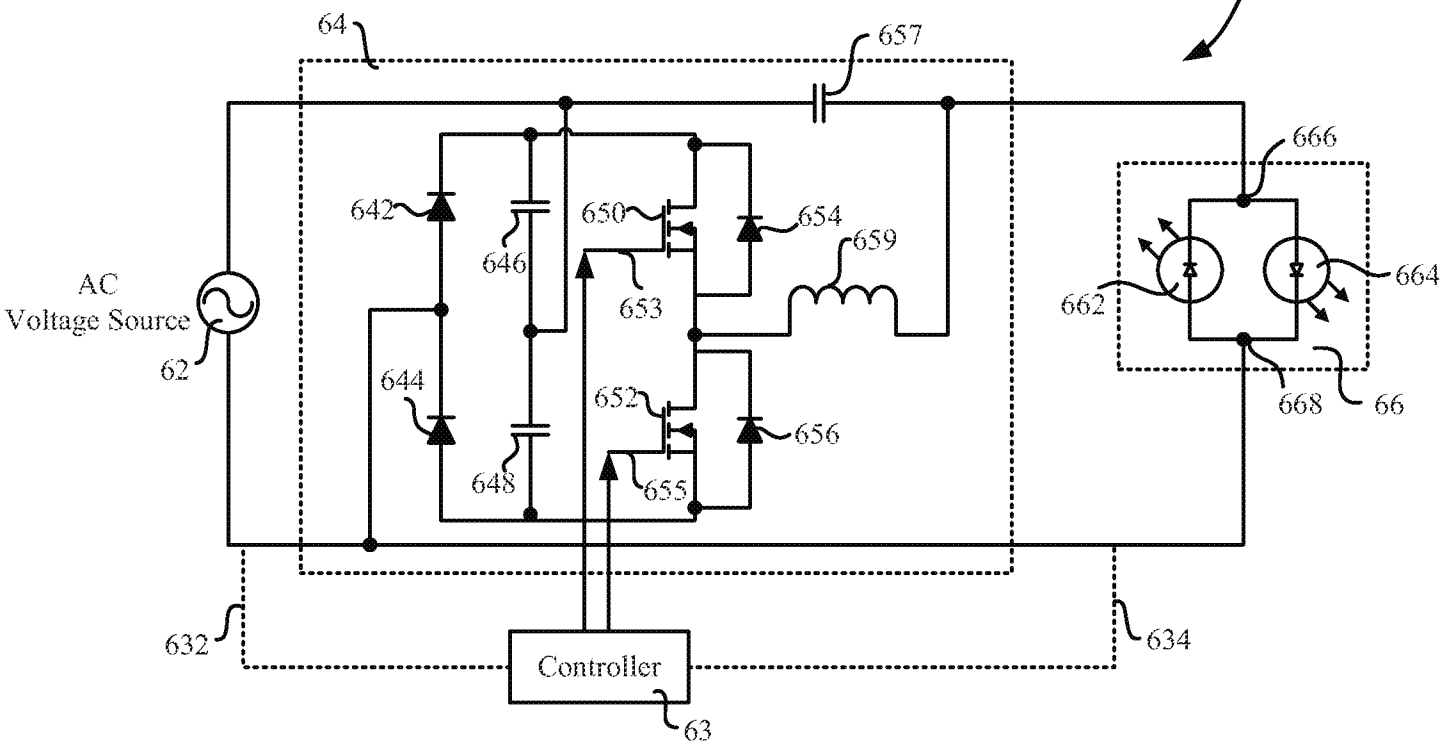
FIG. 12 is a schematic circuit diagram of a system for driving light emitting diodes in accordance with still another embodiment.

Referring to FIG. 12, a system 60 in accordance with still another embodiment is shown. In the illustrated embodiment, the system 60 includes an AC voltage source 62, a controller 63, a dynamic voltage restorer (DVR) 64, and an AC driven LED unit 66. The AC voltage source 62 and the AC driven LED unit 66 are substantially the same as that shown in FIG. 1, FIG. 2, FIG. 6, FIG. 8, and FIG. 11, and thus, for the purpose of simplicity, a detailed description of the AC voltage source 62, the controller 63, and the AC driven LED unit 66 are omitted here. For example, the controller 63 may be either coupled to the AC voltage source side by a first electrical connection 632 or the AC driven LED side by a second electrical connection 634 to provide feedback control.

In the illustrated embodiment of the system 60, The DVR 64 includes a pair of rectifying diodes 642 and 644, a pair of capacitors 646 and 648, a pair of switching elements 650 and 652, and a pair of protection diodes 654 and 656. The pair of rectifying diodes 642, 644 is jointly coupled to one terminal of the AC voltage source 62. The pair of capacitors 646, 648 is jointly coupled to the other terminal of the AC voltage source 62. The pair of protection diodes 654, 656 is connected in parallel connected with the pair of switching elements 650, 652 respectively. In addition, the DVR 64 includes a capacitor 657 and an inductor 659. The capacitor 657 and the inductor 659 functions as a low pass filter for filtering high frequency noise signals generated by the pair of switching elements 650 and 652 of the system 60. In other embodiments, the capacitor 657 and the inductor 659 may be omitted from the system 60.

A pair of gate terminals 653, 655 of the pair of switching elements 650, 652 is coupled to the controller 63 for receiving pulse signals from the controller 63. In particular, the pulse signals are supplied to the pair of gate terminals 653, 655 of the pair of switching elements 650, 652 to enable the pair of switching elements 650, 652 to be turned on and off in a complementary manner. Furthermore, by varying a duty cycle of the pulse signals, the system 60 can be operated to provide conditioning of the AC voltage applied to the AC driven LED unit 66. Hence, a dimming control of the AC driven LED unit 66 can also be realized.

Figure 13:
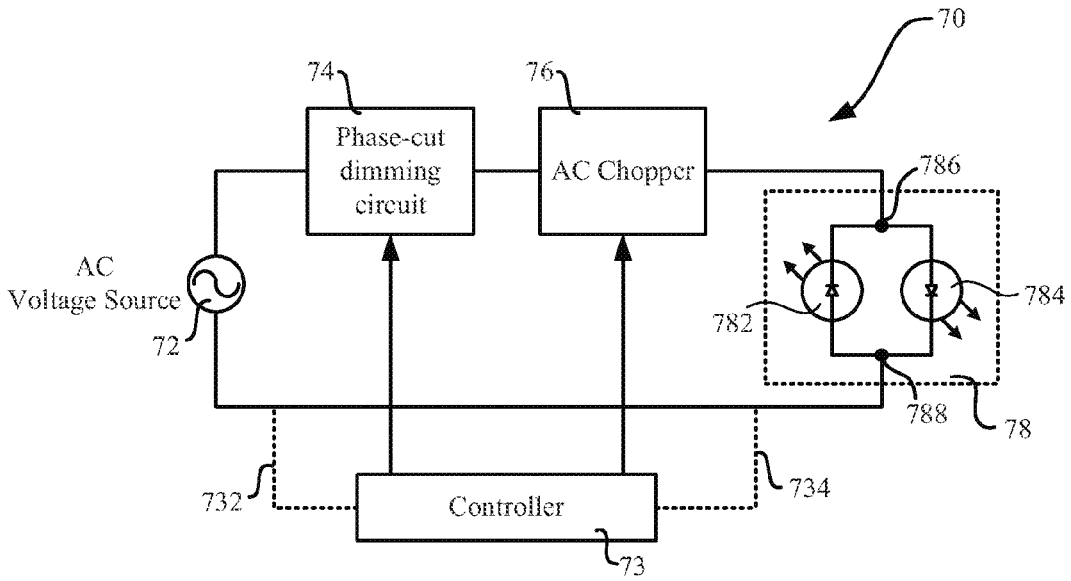
FIG. 13 is a schematic circuit diagram of a system for driving light emitting diodes in accordance with still another embodiment.

Referring to FIG. 13, a system 70 in accordance with still another embodiment is shown. In the illustrated embodiment, the system 70 includes an AC voltage source 72, a controller 73, a phase-cut dimming circuit 74, an AC chopper 76, and an AC driven LED unit 78. The AC voltage source 72, the controller 73, and the AC driven LED unit 78 are substantially the same as those shown in FIG. 1, FIG. 2, FIG. 6, FIG. 8, FIG. 11, and FIG. 12, and thus, for the purpose of simplicity, a detailed description of the AC voltage source 72, the controller 73, and the AC driven LED unit 78 are omitted here. For example, the controller 73 may be either coupled to the AC voltage source side by a first electrical connection 732 or the AC driven LED side by a second electrical connection 734 to provide feedback control.

In the illustrated embodiment of the system 70, the phase-cut dimming circuit 74 and the AC chopper 76 are connected in series between the AC voltage source 72 and the AC driven LED unit 78. The AC chopper 74 may be constructed similarly to the AC chopper 24 shown in FIGS. 2-3 having a single controllable switching element. The AC chopper 74 may also be constructed similarly to the AC chopper 34 shown in FIGS. 6-7 having two controllable switching elements. The phase-cut dimming circuit 76 can be operated to change a conduction angle of the AC voltage output from the AC voltage source 72 to provide a first dimming control of the AC driven LED unit 78. In particular, the AC chopper 74 may receive pulse signals from the controller 73. By varying duty cycle of the pulse signals, a second dimming control of the AC driven LED unit 78 can be provided.

Figure 14:
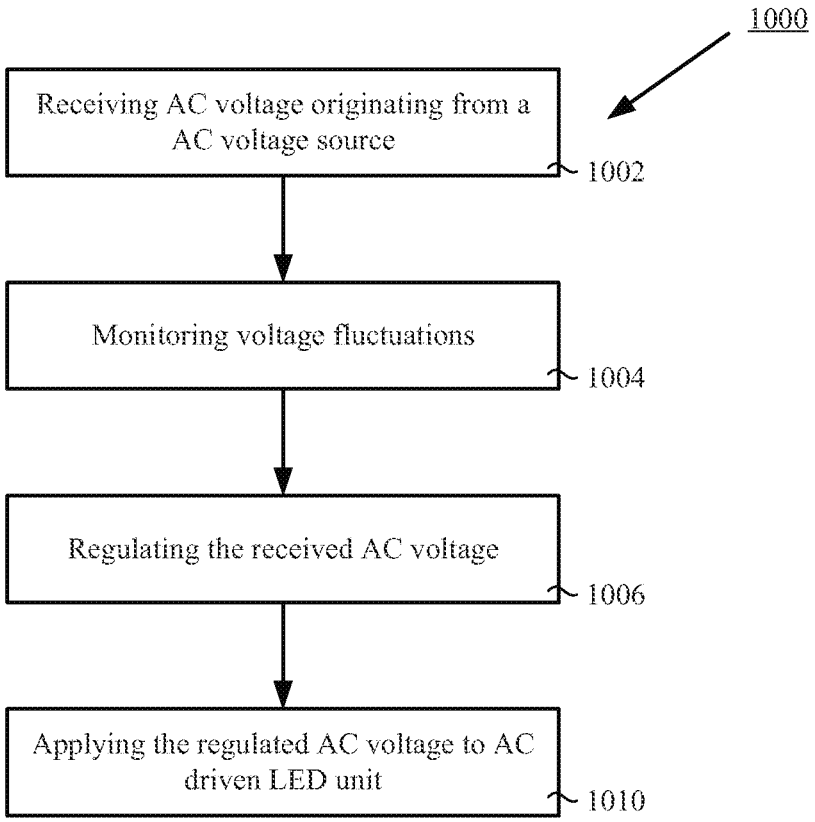
FIG. 14 is a flowchart illustrating a method for driving light emitting diodes in accordance with one embodiment.

Referring to FIG. 14, a flowchart of a method 1000 for driving light emitting diodes in accordance with one embodiment is illustrated. For implementation of the method 1000, various steps as described below of the method 1000 may be tied to various components of the various systems as describe above.

At step 1002, the method 1000 begins by receiving an AC voltage originating from an AC voltage source. In one implementation, the step 1002 is tied to the AC regulator 14 of the system 10 shown in FIG. 1. In particular, the AC regulator 14 receives AC voltage 122 from the AC voltage source 12.

At step 1004, the method 1000 continues by monitoring voltage fluctuations. In one implementation, as shown in FIG. 1, the controller 13 can be coupled to the AC voltage source side to monitor fluctuation of the AC voltage from the AC voltage source 12. In another implementation, the controller 13 can be coupled to the AC driven LED side to monitor fluctuation of the AC voltage applied to the AC driven LED unit 16.

At step 1006, the method 1000 continues by regulating the received AC voltage. In one implementation, the step 1006 of the method 1000 is also tied to the AC regulator 14 of the system 10. In particular, the AC regulator 14 regulates the AC voltage received from the AC voltage source 12 by performing direct AC-AC conversion to the received AC voltage. In addition, the AC regulator 14 of the system 10 may convert the AC voltage to have a predetermined voltage level according to control signals transmitted from the controller 13 of the system 10, so as to maintain the light emitted from the AC driven LED unit 16 at a predetermined level. Furthermore, the duty cycle of the control signals can be varied to adjust the voltage level of the regulated AC voltage, so as to achieve dimming control of the AC driven LED unit 16.

In another implementation, the step 1006 of the method 1000 may be tied to the boost circuit 44 of the system 40. The boost circuit 44 boosts the received AC voltage from the AC voltage source 42 for improving power factor, reducing THD, and mitigating flicker phenomenon. It should be understood that, in other embodiments, the boost circuit 44 may be configured to double a frequency of the current in each half cycle of the AC voltage. As such, the flicker phenomenon of the second LED 464 as well as the first LED 462 can be further mitigated.

In yet another implementation, the step 1006 of the method 1000 may be tied to the DVR 64 of the system 60. The DVR 64 provides voltage conditioning to the received AC voltage, so as to maintain the light emitted from the AC driven LED unit 66 at a predetermined level.

At step 1010, the method 1000 further continues by applying the regulated AC voltage to the AC driven LED unit. In one implementation, the step 1010 of the method 1000 is also tied to the AC regulator 14. The AC regulator applies the regulated AC voltage to the AC driven LED unit 16, such that the AC driven LED unit 16 is capable of emitting light.

In the illustrated embodiment of the method 1000, four steps 1002, 1004, 1006, and 1010 are described above. It will be understood that, one or more steps may be included in alternative embodiments.

Figure 15:
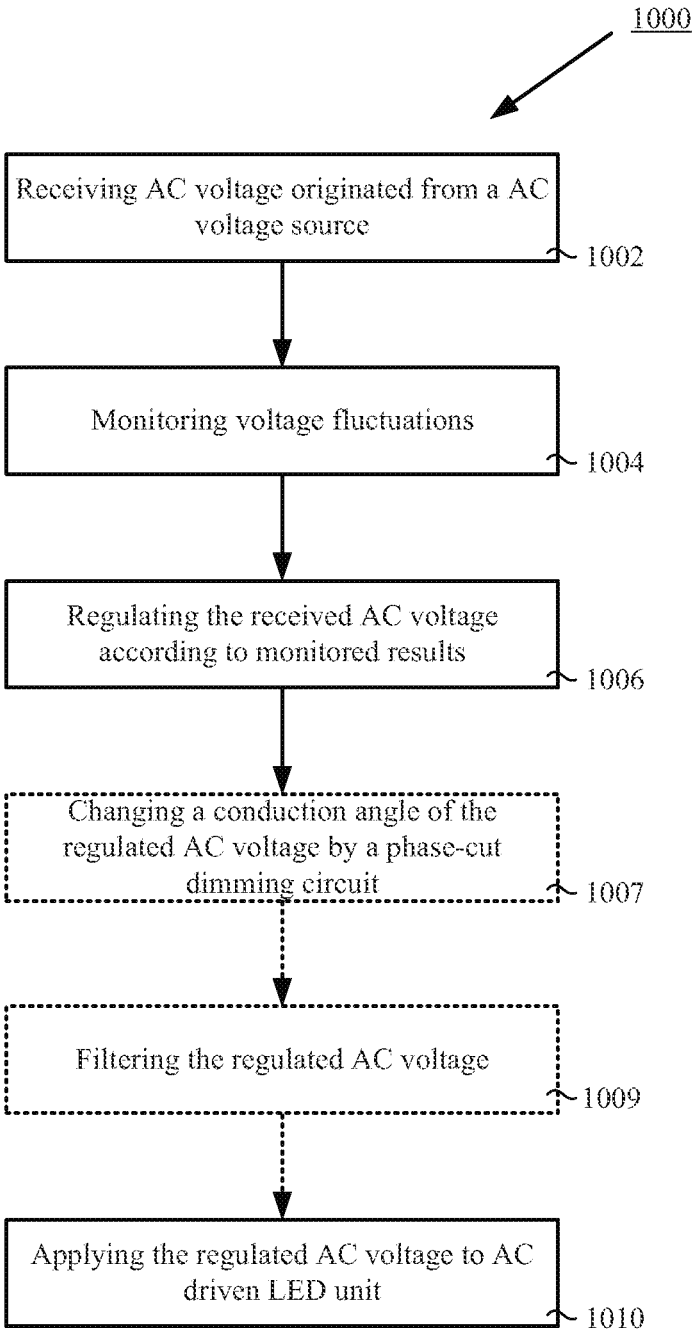
FIG. 15 is a flowchart illustrating a method for driving light emitting diodes in accordance with another embodiment.

For example, in one implementation, as shown in FIG. 15, the method 1000 further includes a step 1007. The step 1007 may be tied to the phase-cut dimming circuit 76 of the system 70. The phase-cut dimming circuit 76 is operated to change conduction angle of the AC voltage to provide a dimming control of the AC driven LED unit 78.

For another example, as shown in FIG. 15, the method 1000 may further include a step 1009. The method moves to step 1009 for filtering the regulated AC voltage. In one implementation, the step 1009 may be tied to the filter circuit 36 of the system 30. The filter circuit 36 filters high frequency noise signals due to switching operations of the switch elements 342, 344 of the AC chopper 34.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. The various features described, as well as other known equivalents for each feature, can be mixed and matched by one of ordinary skill in this art to construct additional systems and techniques in accordance with principles of this disclosure.

The invention claimed is:

1. A system for driving light emitting diodes (LED), the system comprising:

an alternating current (AC) driven LED unit, the AC driven LED unit comprising a first LED and a second LED, the first LED and the second LED being coupled in reverse parallel;

an alternating current voltage regulator coupled between an AC voltage source and the AC driven LED unit; and a controller coupled to the AC voltage regulator, the controller configured to monitor AC voltage fluctuations of the AC voltage source and a regulated AC voltage supplied to the AC driven LED unit, and transmit control signals to the AC voltage regulator according to a monitored result, wherein the AC voltage regulator is operable to receive an AC voltage originating from the AC voltage source, and the AC voltage regulator is operable to regulate the AC voltage from the AC voltage source in response to the control signals transmitted from the controller, and to apply the regulated AC voltage to the AC driven LED unit, allowing the first LED and the second LED to emit light according to the regulated AC voltage;

the controller is configured to monitor the AC voltage source for voltage fluctuation of the AC voltage from the AC voltage source and generate a first control signal to control the AC voltage regulator to maintain the regulated AC voltage from the AC voltage regulator supplied to the AC driven LED unit at a predetermined level; and the controller is configured to monitor the AC driven LED unit to monitor a voltage fluctuation of the regulated AC voltage from the AC voltage regulator and generate a second control signal to control the AC voltage regulator to maintain the regulated AC voltage at the predetermined level.

2. The system of claim 1, wherein the AC voltage regulator comprises an AC chopper operable to selectively chop out at least a portion of the AC voltage from the AC voltage source according to a desired AC voltage to drive the AC driven LED unit so as to maintain the light emitted from the first LED and the second LED at a constant level.

3. The system of claim 2, wherein the AC chopper comprises a switch, the control signals transmitted from the controller comprise pulse signals, and the switch is capable of being turned on and off to regulate the AC voltage from the AC voltage source in response to the pulse signals supplied thereto.

4. The system of claim 3, wherein a voltage level of the regulated AC voltage applied to the AC driven LED unit is adjustable by varying a duty cycle of the pulse signals supplied to the switch, so as to achieve a dimming control of the first LED and the second LED.

5. The system of claim 2, wherein the AC chopper comprises a first switch and a second switch, the first switch is coupled in series between the AC voltage source and the AC driven LED unit, the second switch is coupled in parallel to the AC driven LED unit, the control signals transmitted from the controller comprise pulse signals, and the first switch and the second switch are turned on and off substantially in a complementary manner in response to the pulse signals supplied thereto.

6. The system of claim 5, further comprising a filter circuit, the filter circuit being operable to filter high frequency noise signals generated due to switching operations of the first switch and the second switch.

7. The system of claim 2, wherein the AC chopper comprises a boost circuit operable to boost the AC voltage from the AC voltage source, to allow the regulated AC voltage to be greater than the AC voltage so as to prolong light emission time of the first LED and the second LED for reducing total harmonic distortion and mitigating flicker phenomenon.

8. The system of claim 2, wherein the AC chopper comprises a buck-boost circuit operable to buck or boost the AC voltage from the AC voltage source, to allow the regulated AC voltage to be smaller or greater than the AC voltage from the AC voltage source.

9. The system of claim 2, further comprising a phase-cut dimming circuit connected between the AC voltage source and the AC driven LED unit, the phase-cut dimming circuit configured to provide a dimming control of the first LED and the second LED, wherein the phase-cut dimming circuit and the AC chopper are connected together in series between the AC voltage source and the AC driven LED unit, an input of the phase-cut dimming circuit connected to the AC voltage source and an output of the phase-cut dimming circuit connected to an input of the AC chopper.

10. The system of claim 1, wherein the AC voltage regulator comprises a dynamic voltage restorer (DVR), the DVR is operable to receive the AC voltage from the AC voltage source, and provide conditioning of the AC voltage applied to the first LED and the second LED.

11. The system of claim 1, further comprising a phase-cut dimming circuit coupled between the AC voltage regulator and the AC driven LED unit, the phase-cut dimming circuit is configured to provide a dimming control of the first LED and the second LED.

12. A system for driving an alternating current (AC) driven LED unit with an AC voltage originating from an AC voltage source, the AC driven LED unit having a first LED and a second LED arranged in reverse parallel, the system comprising:

an alternating current (AC) voltage regulator, the AC voltage regulator being operable to receive the AC voltage originating from the AC voltage source, and to modulate the received AC voltage with pulse signals, a voltage level of the modulated AC voltage being adjusted by varying a duty cycle of the pulse signals to achieve a first dimming control of the first LED and the second LED;

a phase-cut dimming circuit coupled to the AC voltage regulator, the phase-cut dimming circuit being operable to change a conduction angle of the received AC voltage to achieve a second dimming control of the first LED and the second LED; and a controller, the controller configured to receive a first feedback control signal from the AC voltage source indicating a voltage fluctuation of the AC voltage from the AC voltage source and generate a first control signal to the AC voltage regulator to maintain the modulated AC voltage at a predetermined level;

the controller configured to receive a second feedback control signal from the AC driven LED unit indicating a voltage fluctuation of the regulated AC voltage from the AC voltage regulator and generate a second control signal to the AC voltage regulator to maintain the modulated AC voltage at the predetermined level.

13. The system of claim 12, further comprising a boost circuit operable to boost the AC voltage from the AC voltage source, to allow the modulated AC voltage to be greater than the AC voltage from the AC voltage source, so as to prolong light emission time of the first LED and the second LED for reducing total harmonic distortion and mitigating flicker phenomenon.

14. A method for driving an alternating current (AC) driven light emitting diodes (LED) unit, the AC driven LED unit comprising a first LED and a second LED, the first LED and the second LED being coupled in reverse parallel, the method comprising:

receiving an AC voltage originating from an AC voltage source and generating a regulated AC voltage from an AC voltage regulator;

using a controller to monitor fluctuations of the received AC voltage and the regulated AC voltage;

applying the regulated AC voltage to the AC driven LED unit to drive the first LED and the second LED to emit light;

wherein monitoring fluctuations of the received AC voltage and the regulated AC voltage by the controller comprises:

receiving a first feedback control signal from the AC voltage source indicating a voltage fluctuation of the AC voltage from the AC voltage source and generating a first control signal to the AC voltage regulator to maintain the regulated AC voltage from the AC voltage regulator at a predetermined level; and receiving a second feedback control signal from the AC driven LED unit to monitor a voltage fluctuation of the regulated AC voltage and generating a second control signal to the AC voltage regulator to maintain the regulated AC voltage at the predetermined level.

15. The method of claim 14, further comprising changing a conduction angle of the AC voltage originating from the AC voltage source by a phase-cut dimming circuit, so as to achieve a first dimming control of the first LED and the second LED.

16. The method of claim 14, wherein the step of regulating the received AC voltage comprises selectively chopping out at least a portion of the received AC voltage using an AC chopper.

17. The method of claim 16, wherein the AC chopper comprises a switch and wherein the step of chopping out at least a portion of the received AC voltage comprises turning on and off the switch to regulate the received AC voltage in response to pulse signals supplied to the switch.

18. The method of claim 17, further comprising varying a duty cycle of the pulse signals supplied to the switch to adjust a voltage level of the regulated AC voltage applied to the AC driven LED unit, so as to achieve a second dimming control of the first LED and the second LED.

19. The method of claim 14, further comprising boosting the received AC voltage by a boost circuit to allow the regulated AC voltage to be greater than the AC voltage received from the AC voltage source.

20. The method of claim 14, wherein the AC voltage regulator comprises a dynamic voltage restorer and wherein the method further comprises providing conditioning of the AC voltage applied to the AC driven LED unit by the dynamic voltage restorer.

* * * * *